US009713412B2

(12) United States Patent
Maurer

(10) Patent No.: US 9,713,412 B2
(45) Date of Patent: Jul. 25, 2017

(54) CLEANING SYSTEM

(71) Applicant: Creative Products International, Inc., Holland, MI (US)

(72) Inventor: David A. Maurer, Fort Collins, CO (US)

(73) Assignee: CREATIVE PRODUCTS INTERNATIONAL, INC., Holland, MI (US)

( * ) Notice: Subject to any disclaimer, the term of this patent is extended or adjusted under 35 U.S.C. 154(b) by 599 days.

(21) Appl. No.: 14/178,011

(22) Filed: Feb. 11, 2014

(65) Prior Publication Data

US 2015/0223663 A1 Aug. 13, 2015

(51) Int. Cl.
*A47L 13/16* (2006.01)
*A47L 13/20* (2006.01)
*A47L 13/256* (2006.01)

(52) U.S. Cl.
CPC ..... *A47L 13/256* (2013.01); *A47L 13/16* (2013.01); *A47L 13/20* (2013.01)

(58) Field of Classification Search
CPC ..... A47L 13/16; A47L 13/20; A47L 13/256
See application file for complete search history.

(56) References Cited

U.S. PATENT DOCUMENTS

| | | | | |
|---|---|---|---|---|
| 3,333,293 | A * | 8/1967 | Skurdelis | A47L 13/256 15/145 |
| 3,761,991 | A | 10/1973 | Moss | |
| 3,805,315 | A | 4/1974 | Moss | |
| 4,152,084 | A | 5/1979 | Melton et al. | |
| 4,254,530 | A | 3/1981 | Lambert | |
| 4,364,144 | A | 12/1982 | Moss et al. | |
| 5,848,451 | A | 12/1998 | Barnett | |
| 5,887,311 | A | 3/1999 | Kresse et al. | |
| 7,181,801 | B1 | 2/2007 | Kresse et al. | |
| 7,487,567 | B2 | 2/2009 | Kresse et al. | |
| 7,743,453 | B2 | 6/2010 | Kresse et al. | |
| 8,245,351 | B2 | 8/2012 | Rosensweig et al. | |
| 2004/0068817 | A1* | 4/2004 | Policicchio | A47L 13/16 15/228 |
| 2007/0061987 | A1 | 3/2007 | Kresse | |
| 2007/0256261 | A1 | 11/2007 | Benitez, Jr. et al. | |
| 2011/0010989 | A1 | 1/2011 | Hinsperger | |

FOREIGN PATENT DOCUMENTS

| | | |
|---|---|---|
| GB | 2478242 | 8/2011 |

OTHER PUBLICATIONS

International Preliminary Report on Patentability issued by International Bureau of WIPO in connection with PCT/US2014/072135 on Aug. 25, 2016.
International Search Report for PCT/US14/72135 dated Mar. 18, 2015.

* cited by examiner

*Primary Examiner* — Randall Chin
(74) *Attorney, Agent, or Firm* — Levenfeld Pearlstein, LLC

(57) ABSTRACT

A mesh back mop head includes a cleaning surface and a backing member. The cleaning surface is secured to the backing member along a plurality lines to define channels in the cleaning surface. The backing member is formed from an open mesh material that substantially allows the free flow of liquid therethrough. The backing member includes at least one receiver operably mounted to the backing member for receiving a mop head frame. A cleaning system and a method of cleaning using the mesh back mop head are disclosed.

8 Claims, 2 Drawing Sheets

CLEANING SYSTEM

BACKGROUND

Cleaning systems are in widespread use in institutional settings, such as hospitals, schools, rehabilitation facilities and the like. Due to the repetitive nature of the cleaning procedures and the high quality standards that are required, highly efficient processes require highly efficient equipment and systems. Such high efficiency also helps promote reduced cleaning times with as good or better cleaning results.

In the past, mop systems were conventional wet mops with cotton or other fiber strings that were soaked in water or water with a cleaning fluid, wrung out and used to clean a floor. The mops themselves were soaked and re-soaked in the water or water/cleaning fluid and as a result the water became dirty with the re-soaked mop and the mop did not provide the necessary high quality cleaning.

One type of mop that has become popular is a microfiber flat mop that fits onto a frame. These mops provide a high level of cleaning quality in that they are readily removed from the frame for replacement. The mop heads are pre-wetted prior to use, with an appropriate cleaning solution. As such, when the mop head (the flat mop portion) become dirty, a new mop head is installed on the frame and the cleaning process can continue.

Known mop heads has a microfiber cleaning face and a high strength, tight weave density, such as canvas backing. The cloth backing helps the mop head to retain it shape and integrity. In that such mop heads are not inexpensive, the mop heads are reused numerous, indeed, many times over.

In a typical system, a number of mop heads are placed into a container in which the mop heads tightly fit to the sides. A cleaning solution is applied (poured) over the mop heads to pre-wet the heads. Due to the tight weave of the mop head backing, the mop heads can take a considerable period of time to pre-wet. It has been known for mop heads to take as long as 15-20 minutes until the cleaning fluid sufficiently pre-wets or wicks into the microfiber cleaning portion of the head. In some cases, the container has to be inverted (turned upside down) in order for the mop heads to fully pre-wet.

Accordingly, there is a need for a mop head and system that allows for quickly and efficiently pre-wetting microfiber and other flat mop heads. Desirably such a system permits such mop heads to be pre-wetted almost immediately upon application of a cleaning solution to multiple heads in a container.

SUMMARY

A cleaning system includes a mop head having a cleaning surface and a mesh backing member. The mop head and system allow for quickly and efficiently pre-wetting microfiber and other flat mop heads almost immediately upon application of a cleaning solution to multiple heads in a container, and without any wait time for the cleaning solution to wick into the mop heads.

In an embodiment, the cleaning surface is secured to the backing member along a plurality lines to define channels in the cleaning surface. The backing member is formed from an open mesh material that substantially allows the free flow of liquid therethrough. The backing member includes at least one receiver operably mounted to the backing member for receiving a mop head frame.

In an embodiment, the mesh is a polymeric coated mesh, such as a polymeric coated fiber material formed in an open mesh to permit liquid to pass through the mesh.

The backing member can include two receivers, spaced from and opposing one another affixed to the backing member opposite the cleaning surface. The receivers can be formed as pockets and can be formed from the open mesh material.

A cleaning system includes the a mesh back mop head a mop head frame having at least one, and may have two cooperating securing members for removably securing the mop head thereto, a handle operably connected to the mop head frame and a container configured to receive a plurality of mesh back mop heads.

The mop head frame can include a connector for releasably connecting a handle thereto. A swivel base can be operably connected to the connector. The swivel base has a two-axis gimbal joint to permit rotation of the rotation of the handle in at least two directions relative to the mop head frame.

A method for cleaning includes the steps of applying a cleaning solution to a plurality of mop heads in a container such that the cleaning solution soaks into each of the plurality of mop heads and immediately thereafter, removing at least one mop head from the container and positioning the mop head on a mop head frame for use.

These and other features and advantages of the present device and method will be apparent from the following detailed description, in conjunction with the appended claims.

BRIEF DESCRIPTION OF THE DRAWINGS

The benefits and advantages of the present disclosure will become more readily apparent to those of ordinary skill in the relevant art after reviewing the following detailed description and accompanying drawings, wherein.

DESCRIPTION

Figure 1:
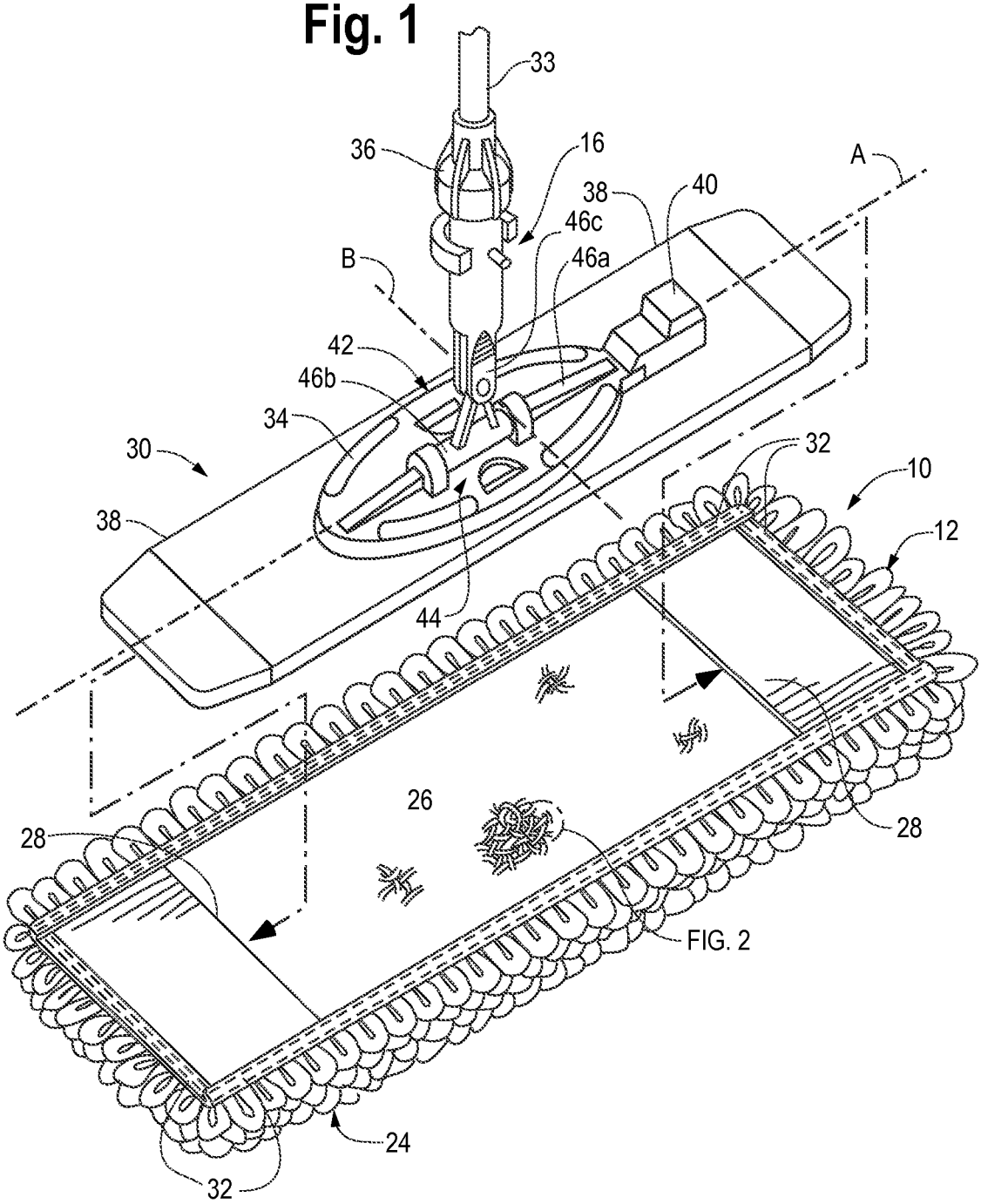
FIG. 1 is a perspective view of a mop head and mop, the mop head being a mesh back mop head.

While the present device is susceptible of embodiment in various forms, there is shown in the drawings and will hereinafter be described a presently preferred embodiment with the understanding that the present disclosure is to be considered an exemplification thereof and is not intended to be limited to the specific embodiment illustrated.

Figure 6:
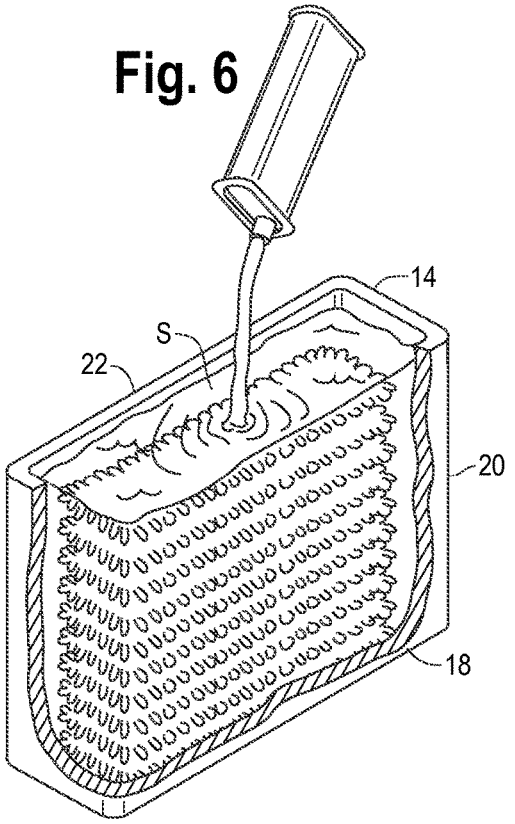
FIG. 6 is an illustration showing a plurality of mop heads in a bucket with liquid being added to the bucket.

Referring now to the figures and briefly to FIGS. 1 and 6, there is shown a system 10 for cleaning with a rapidly pre-wetted mesh back mop head 12. The system 10 includes a storage container 14, a mop 16 and one or more mesh back mop heads 12. The container 14 is of a known type have a bottom wall 18 contiguous with four upstanding side walls 20. A lid (not shown) is fitted onto a top edge 22 of the container 14. In an embodiment, the lid seals to the top edge 22 of the container 14.

The mesh back mop head 12 and mop 16 are illustrated in FIG. 1. The mop head 12 includes a cleaning surface 24, such as a microfiber cleaning surface, a backing element or backing sheet 26 to which the cleaning surface 24 is affixed and frame receivers 28 for receiving portions of a frame 30 to which the mop head 12 is secured. In a present embodiment, the frame receivers 28 are formed as pockets secured at their respective peripheries 32 to the backing element 26.

The mop 16 includes generally a pole or elongated handle 33 and the head frame 30 to which the mop head 12 is secured. The frame 30 includes a base 34, a connector 36 on the base 34, and a pair of wings or securing members 38 operably mounted to the base 34 that insert into the pockets 28 on the mop head 12 for securing the mop head 12 to the frame 30. In an embodiment, the wings 38 are hinged and fold inwardly toward one another to insert into the pockets 28. The wings 38 then lock into a flat or extended position. A release button or lever 40 on the frame 30 releases the wings from the extended position to allow the wings to fold toward one another to install and remove the mop head 12 from the frame 30.

The connector 36 mounts to the base 34 by a swivel joint 42. In one embodiment, the swivel joint 42 is formed as a two-axis, gimbal-like joint 44, and includes first, second and third swivel parts 46*a,b,c*. The first swivel part 46*a* is mounted to the base 34 in a fixed arrangement, but may be configured so that it is removable from the base 34. The second swivel part 46*b* is rotationally coupled to the first swivel part 46*a* and is rotatable about a first axis 'A' in first and second directions. The third swivel part 46*c* is rotationally coupled to the second swivel part 46*b*, and rotates about a second axis 'B', extending in a different direction than the first axis 'A'. In this configuration, the third swivel part 46*c* rotates in third and fourth directions.

The third swivel part 46*a* is operably mounted to the connector 36, which is configured for connection to the handle 33. The connector 36 can secure to the handle 33 by any of a number of known ways, such as by a threaded connection, a bayonet connection, a clamp connection or the like to fasten the mop frame 30 to the handle 33 and to preclude the frame 30 from rotating about the handle 33.

The mop head 12 is of a unique design. As noted above, one cleaning surface 24 is formed from a microfiber material in which microfiber ropes 48 are secured along an intermediate portion (as indicated at 50) of the ropes to the backing member 26 to form loops 52. The securing locations, which can be stitching, define a plurality of lines 51 that define channels 54 along the cleaning surface 24 where the loops 52 are secured to the backing member 26. In such a configuration, the loops 52 extend away (or depend as seen in FIGS. 4 and 5) from the backing member 26 where they are secured to the member 26.

Figure 2:
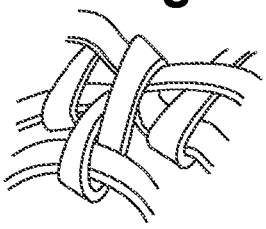
FIG. 2 is an enlarged view of the area indicated in the circle in FIG. 1, showing the mesh backing of the mop head.
Figure 3:
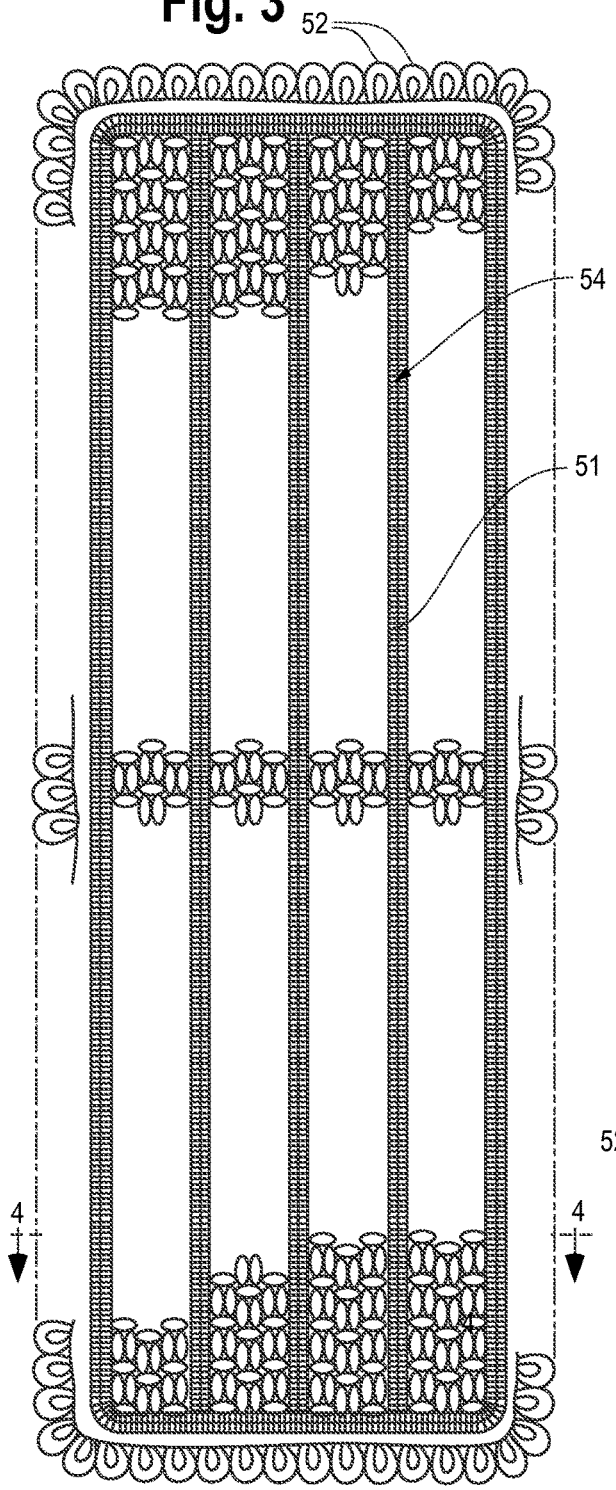
FIG. 3 is a partial bottom view of the mop head.

Unlike prior known designs that utilize a densely woven backing member, a present mop head 12 uses a mesh backing member 26. As best seen in FIG. 2, the mesh backing element 26 is an open mesh that substantially allows the free flow of liquid therethrough. The mesh backing member 26 provides a sufficiently strong base on which the cleaning surface ropes 48 are mounted, while at the same time, as is discussed below, permits the mop head 12 to be quickly and efficiently pre-wetted with cleaning solution S. One mesh back mop head 12 uses a polymeric coated fiber material that has an open mesh size of about 1/16 to about 1/8 inch. That is, the openings in the mesh are about 1/16 to about 1/8 inch to permit liquid, such as a cleaning solution to pass through the mesh. The polymeric coating precludes the base material, i.e., the mesh material, from absorbing liquid. As such, the cleaning solution may not wick into the mesh itself, but may pass through the backing material and into the cleaning surface (e.g., the microfiber rope material). Those skilled in the art will recognize the other suitable types of materials and mesh sizes that can be used for the mop head backing element 26, such other materials providing the free flow of cleaning solution and material strength. It will be understood that such other suitable materials are with the scope and spirit of the present disclosure.

Figure 5:
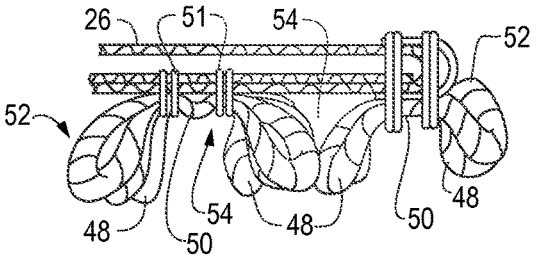
FIG. 5 is an enlarged view of the area indicated in the circle in FIG. 4, showing the edge of the mop head.
Figure 4:
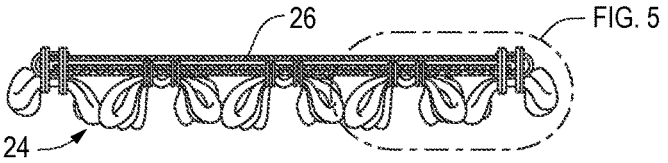
FIG. 4 is a sectional view taken along line 4-4 of FIG. 3.

As is seen in FIGS. 4 and 5, the cleaning surface loops 52 extend away from the backing element 26, such that the backing element 26 is slightly smaller than a footprint of the cleaning surface 24 when in use, which permits full use of the cleaning surface 24. This, along with the mesh backing element 26, facilitates immediate pre-wetting (or wicking) of the cleaning solution S into the material of the cleaning surface 24, e.g., the cleaning surface ropes 48 or loops 52.

In use, multiple mop heads 12 are placed in the container 14. The number of mop heads 12 can vary, but it is not uncommon to place or stack as many as 10-15 mop heads 12 in a single container 14. The cleaning solution S, which has been previously prepared, is then poured over the mop heads 12 in the container 14. Unlike known systems in which the container must be inverted and/or the mop heads must be allowed to rest for as much as 15-20 minutes prior to use to allow for the solution to wick into the mop heads and cleaning surfaces, the present mop heads 12 permit almost immediate use of the mop heads 12 in the container 14 after addition of the solution S. This is because the mesh backing element 26 permits the free flow of the cleaning solution (with far less resistance to flow therethrough than known mop heads) and thus eliminates or greatly reduces the time needed for the solution to wick into the cleaning surfaces 24, e.g., the cleaning surface ropes 48 or loops 52, of the stacked mop heads 12.

The mops heads 12 are then removed from the container 14, installed on the mop head frame 30, and the mop 16 is ready for use. Following use, the mop 16 can be positioned over a used mop head container, the mop head 12 released from the frame 30, the mop head placed in a used mop container for proper disposition and a new mop head installed on the frame 30.

It will be appreciated by those skilled in the art that the relative directional terms such as sides, top, bottom, upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular. Further, any object modified by the word "associated" shall be construed so that it is not an element of the claim, but rather an object that is acted upon or used by the elements of the claim.

From the foregoing it will be observed that numerous modifications and variations can be made to the device without departing from the true spirit and scope of the novel concepts of the present disclosure. It is to be understood that no limitation with respect to the specific embodiments illustrated is intended or to be inferred. The disclosure is intended to cover all such modifications as fall within the scope of the claims.

What is claimed is:

1. A mop head comprising:

a cleaning surface;

a backing member, the cleaning surface secured to the backing member along a plurality of lines to define channels in the cleaning surface, the backing member being formed from an open mesh material that substantially allows the free flow of liquid therethrough, the open mesh being formed from a polymeric coated fiber material and being substantially liquid impermeable; and at least one receiver operably mounted to the backing member for receiving a mop head frame.

2. The mop head of claim 1 including two receivers, spaced from and opposing one another affixed to the backing member opposite the cleaning surface.

3. The mop head of claim 2 wherein the receivers are formed as pockets.

4. The mop head of claim 2 wherein the receivers are formed from the open mesh material.

5. A cleaning system comprising:

a mesh back mop head having a cleaning surface, a backing member, and at least one receiver operably mounted to the backing member for receiving a mop head frame, wherein the cleaning surface is secured to the backing member along a plurality of lines to define channels in the cleaning surface and wherein the backing member is formed from an open mesh material that substantially allows the free flow of liquid therethrough, the open mesh being formed from a polymeric coated fiber material and being substantially liquid impermeable;

a mop head frame having at least one cooperating securing member for removably securing the mop head thereto;

a handle operably connected to the mop head frame; and a container configured to receive a plurality of mesh back mop heads.

6. The cleaning system of claim 5 wherein the mop head frame includes a connector for releasably connecting a handle thereto.

7. The cleaning system of claim 6 including a swivel base operably connected to the connector, the swivel base having a two-axis gimbal joint to permit rotation of the rotation of the handle in at least two directions relative to the mop head frame.

8. The cleaning system of claim 5 including a pair of cooperating securing member for removably securing the mop head thereto.

* * * * *